United States Patent [19]

Dybala et al.

[11] Patent Number: 4,529,028

[45] Date of Patent: Jul. 16, 1985

[54] COATING FOR MOLDS AND EXPENDABLE CORES

[75] Inventors: Charles J. Dybala; John J. Maczko, both of Toledo, Ohio

[73] Assignee: Farley Metals, Inc., Chicago, Ill.

[21] Appl. No.: 492,813

[22] Filed: May 9, 1983

Related U.S. Application Data

[63] Continuation of Ser. No. 321,294, Nov. 13, 1981, abandoned.

[51] Int. Cl.[3] ..... B22C 3/00; B22C 9/10

[52] U.S. Cl. ..... 164/369; 164/138; 164/14; 427/134; 106/38.27; 523/139

[58] Field of Search ..... 427/134, 402; 106/38.27, 38.28, 38.23, 38.24, 38.25; 164/138, 14, 526, 369, 349; 523/139

[56] References Cited

U.S. PATENT DOCUMENTS

| | | | |
|---|---|---|---|
| 2,426,987 | 9/1947 | Dean | 427/134 |
| 3,216,078 | 11/1965 | Zrimsek et al. | 427/134 |
| 3,436,235 | 4/1969 | Baer, Jr. et al. | 106/38.27 |
| 3,666,531 | 5/1972 | Cocks et al. | 106/38.27 X |
| 4,001,468 | 1/1977 | Skubon et al. | 427/134 |
| 4,096,293 | 6/1978 | Skubon et al. | 427/134 |
| 4,298,051 | 11/1981 | Page | 164/72 |
| 4,319,925 | 3/1982 | Brown | 106/38.27 |

FOREIGN PATENT DOCUMENTS

| | | | |
|---|---|---|---|
| 919194 | 2/1963 | United Kingdom | 106/32.23 |

*Primary Examiner*—John D. Smith
*Assistant Examiner*—Bernard F. Plantz
*Attorney, Agent, or Firm*—Hugh Adam Kirk

[57] ABSTRACT

A resin-bonded sand core for high-pressure die casting methods having a first refractory coating, such as of silica, with an inorganic binding agent of colloidal silica and a clay such as kaolin, and a second or top coating of a refractory material containing zircon and an organic binding agent, which combination of these two different coatings enables the bonded sand core to have high pressure and temperature resistance, good washout resistance, freedom from surface penetration, and good shake-out properties.

26 Claims, No Drawings

COATING FOR MOLDS AND EXPENDABLE CORES

This application is a continuation of application Ser. No. 321,294, filed Nov. 13, 1981 now abandoned.

BACKGROUND OF THE INVENTION

The invention primarily relates to the art of die casting such metals as aluminum, zinc, magnesium, copper, iron and their alloys and to a solution to a long standing problem therein; i.e., the lack of a commercially feasible die casting technique to produce castings having undercut regions. More specifically, this invention relates to a coating composition useful on expendable die casting cores and particularly in pressurized die casting methods.

1. Setting of the Invention

Traditional pressure die casting requires molds or dies which are able to withstand high temperatures and pressures. Ferrous materials are commonly used for such molds. Molds or cores of such materials for die castings having complex undercuts and reliefs are not possible since the cores for the undercut and relief cannot be removed from the casting. To attain such complex undercuts and reliefs, sand cores which were expendable and fragile have been employed at pressures under 30 psia, i.e., gravity fed casting.

Sand cores have been employed for high pressure die castings and have been composed of sand mixed with a binding agent. The mixture is formed into the desired core shape and cured, bound together, by use of heat or chemical reaction. The cured core can then be used in the casting process.

The major problem with such expendable core in high pressure die casting methods has been the inability of the single binder system to meet four core requirements. These are (a) good shake-out, (b) good washout resistance, (c) freedom from surface penetration, and (d) strength.

Good shake-out is necessary to facilitate core removal from the casting.

Washout resistance is the ability of the core to withstand erosion from the high metal velocities that occur during injection of the molten metal. The washed out sand adversely affects tolerances on the finished part, since the sand may become embedded within the casting.

Surface penetration or hardness is caused by the combination of high heat and pressure which breaks down the core surface and permits the metal to penetrate between the sand grains thus causing a sand/metal mixture interface at the surface of the casting. This condition is detrimental to subsequent machining and machine tool life. Moreover, should the entrained sand become separated from the casting surface after component installation, damage to related parts, such as the lubrication system of an automobile engine, could result.

The strength of the core is determined mainly by the sand binder used. Therefore, suitable coating and compositions must be compatible with binders having desired strength.

2. Prior Art

Although a wide variety of core and mold coatings have been developed for general foundry use, i.e., gravity fed casting, only a small number of coatings have been designed for the relatively harsh requirements connected with expendable high pressure die casting. Prior art coatings are illustrated by:

U.S. Pat. No. 4,096,293, issued June 20, 1978, entitled "Mold and Core Wash" and issued to Michael J. Skubon et al discloses a core wash useful in pressurized die casting methods made of a hydrocarbon solvent, fumaric resin, particulated calcium aluminate and a suspending agent. The composition comprises 5 to 90 wt % solvent, 0.5 to 5 wt % resin, 5 to 80 wt % calcium aluminate and 0.1 to 2 wt % suspending agent. The fumaric resin is described as the reaction product of fumaric acid, gum rosin and pentaerythritol. The suspending agents are disclosed to include high molecular weight polymers, polyacrylates, colloidal silicas, clay, vegetable gums, and amine-treated bentonite. Wetting agents are disclosed by U.S. Pat. No. 4,096,293 to include methyl alcohol, water, and anionic and cationic surfactants.

The prior art is further illustrated by U.S. Pat. No. 4,001,468, issued Jan. 4, 1977, entitled Method for Coating Sand Cores and Sand Molds and issued to M. J. Skubon et al which discloses a wash coating useful for preventing core erosion. The composition of the coating includes an organic vehicle, suspending agent, refractory material and an organic polymer or copolymer. The organic vehicle is described as having a kauributanol value (ASTM D1133) of 36 or higher. The suspending agent is described as including clay, vegetable gums, and amine-treated bentonite in ratio of suspending agent to vehicle of between 1:80 and 1:250. The refractory powder is described as including graphite, coke, mica, silica, aluminum oxide, magnesium oxide, talc, and zircon flour in a weight ratio of refractory to vehicle of between 1:2.5 and 1:3.5. The organic polymer or copolymer can be vinyl toluene butadiene polymer, styrene/butadiene copolymer, vinyl toluene/acrylate copolymer, styrene/acetylene copolymer, acrylate homopolymer, and styrene/butadiene copolymer in weight ratios of polymer/copolymer to vehicle between 1:50 and 1:200.

Disadvantages of Skubon include use of an organic binder which when heated releases an outgas which causes pores in the casting and lost strength. Further, the Skubon coatings are typically powdery and have reduced scratch resistance or hardness. Hardness is an indication of resistance to metal penetration or metal burning and erosion.

SUMMARY OF THE INVENTION

The present invention in one aspect constitutes a core and first mold wash composition comprising (a) particulate refractory material,
(b) inorganic binding agent and
(c) liquid vehicle and preferably plus a second and different composition top wash coating comprising:

(a) refractory material,
(b) binding agent, and
(c) liquid vehicle

In a second aspect, this invention comprises a method of treating a foundry core or mold by coating the surface of the sand core or mold with a wash of the foregoing composition.

In a third aspect, this invention comprises a mold and expendable core coated with the foregoing composition.

DETAILED DESCRIPTION OF THE INVENTION

The mold and first core wash coating of this invention comprises particulate refractory material, an inorganic binding agent and liquid vehicle. This coating is suitable for use on sand cores and molds which are useful in die casting as well as in gravity fed casting. This invention meets the four core requirements through the use of a core system having a coating-/binder system that enhances shakeout washout resistance and surface penetration resistance. The wash coatings can also include such secondary components such as fungicides, wetting agents and defoaming agents.

The wash coatings are useful on uncoated inorganic and organic sand and binder agent cores which provide good shakeout characteristics but fail to have suitable washout surface penetration resistance and effect in strength. Preferably, the binder agent of the core is a curable organic resin. More preferably, the agent is an acid curable organic resin and oxidizing agent which is cured by exposure to sulfur dioxide.

Suitable refractory materials for this invention should not react with the binder agent and include but are not limited to graphite, mica, fused silica, aluminum oxide, magnesium oxide, carbon black and zircon flour. Preferably, the refractory material is selected from the group consisting of fused silica, zircon flour and aluminum oxide. More preferably, refractory material is fused silica. The refractory material should preferably have a particle size ranging from about 1 to 100 microns. Fused silica having a particle size within the range of about 1 and about 45 microns is most preferred. Preferably the fused silica is wet milled.

Any commercially available inorganic binding agent can be used such as colloidal silica, clay, or amine-treated bentonite or a combination thereof. Preferably, the suspending agent is selected from a group consisting of colloidal silicas, clays and bentonite. More preferably, the agent is colloidal silica.

The liquid vehicle may be either aqueous or organic. Selection of the vehicle is usually based on the type of binder used to bind the sand of the foundry core and mold. If the core binder is aqueous, the vehicle for the coating should preferably be organic. If the core binder is organic, the vehicle for the coating should preferably be aqueous.

Preferably the composition of the core wash should range from about 30 to about 80 wt % refractory material, from about 1 to about 25 wt % binder agent and from about 20 to about 70 wt % liquid vehicle. The more preferred composition ranges from about 50 to 70 wt % refractory material, about 5 to about 12 wt % binder agent and about 25 to about 40 wt % liquid vehicle. The most preferred composition is about 62 wt % refractory material, about 8 wt % binder agent and about 30 wt % liquid vehicle.

The wash coating should preferably form a coating on the sand core having a thickness ranging from about 250 to about 5000 microns. The preferred range of thickness is between 1000 and about 3000 microns.

To prepare an expendable core of the invention, sand and binding agent are mixed and air blown or hand packed into a core box having the desired shape of the core. The core is cured by heating or passing a suitable gas through the core box. The core is removed from the box as a solid mass.

The coating may then be applied to the core by conventional techniques such as dipping or spraying the core. The coating may be applied as single or multiple coats. The core and coating are then allowed to dry.

The coating of this invention may optionally and preferably be covered with a top wash coating containing a refractory material, binding agent, suspending agent and a liquid vehicle. The second coating improves protection of the core and facilitation of core removal from the casting.

The refractory material of the top wash coating may be selected from the group consisting of fused silica, zircon flour and aluminum oxide. Preferably, the material is zircon flour.

The suspending agent of the top wash coating may be selected from a group consisting of but not limited to high molecular weight polymers and copolymers, silicas, vegetable gums, clays and combination thereof. Preferably, the suspending agent of the top wash is selected from a group consisting of colloidal silicas, clays, and bentonite. More preferably, the agent is colloidal silica.

The binding agent of the top wash coating may be organic or inorganic and may be selected from suitable agents such as polymer resin and aluminum boronate.

The liquid vehicle of the top wash may be either aqueous or organic. Selection of the vehicle is usually based on the type of binder used to bind the sand of the foundry core and mold as well as the first coating. If the binder is aqueous, the vehicle for the coating should preferably be organic. More preferably, the top coating comprises zirconium silicate, resin binder and isopropyl alcohol. The top wash coating should preferably form a cured coating on the sand core having a thickness ranging from about 100 to about 2000 microns and the preferred range is from about 250 to 1000 microns.

The second wash coating may be applied as single or multiple coats.

EXAMPLE 1

An expendable sand core was formed of 97.90 wt % silica foundry sand (AFS Fineness No. 65), 1.47 wt % furane and 0.59 wt % methyl ethyl ketone peroxide, and 0.04 wt % silane. The core was treated with sulfur dioxide for 2 seconds at ambient temperature and pressure.

A core wash composition was prepared containing various levels of fused silica, colloidal silica and water, the fused silica particles ranging in size from 1 to 45 microns. The composition was milled by introducing porcelain balls into a container of the composition and rotating the container for 2 to 3 hours to break up large agglomerated particles. The milled composition was poured through a cloth paint strainer. The specific gravity of the composition was then checked and adjusted by addition of fused silica or colloidal silica slurry until the Baume reading fell within the range of 56 and 62. Approximately 10% by volume of methanol was added. An additional amount of kaolin was added to the composition which was then stirred for a minimum of one hour. The composition was then allowed to stand for 24 hours.

The coated cured core was used to produce a complex aluminum alloy die casting having an undercut region. The core was removed from the casting using conventional mechanical shakeout techniques. The core and casting were tested for shakeout, washout and penetration and rated for each characteristic.

EXAMPLE 2

A cured coated core of Example 1 was dipped in the core wash composition for approximately 10 seconds, removed and drained. The coat was allowed to dry. The dry coated core was dipped again in the core wash composition for about 5 seconds, drained and dryed in a circulating air oven at 175° F. for at least 3 minutes. A casting was made using the core and both were rated as in Example 1.

EXAMPLE 3

An uncoated expendable core was prepared as in Example 1, a casting prepared therefrom and the core and casting were tested and rated as in Example 1.

EXAMPLE 4

A coated expendable core was prepared as in Example 1. This core was cooled for at least 2 minutes and dipped in a top coating composition containing zirconium silicate, a resin binder, and isopropyl alcohol (Arcolite #412, Atlantic Richfield Co.) for 2 to 3 seconds. The core was drained and allowed to air dry for 30 minutes. A casting was made using the core.

The double coated core and the casting were rated for shakeout, washout and penetration.

EXAMPLE 5

An uncoated expendable core as prepared as in Example 3 was dipped in the zirconium silicate/resin binder coating composition of Example 4 and allowed to dry. A casting was made of the coated core and casting were rated.

We claim:

1. A strong die casting sand core having a high pressure and temperature resistance, good wash-out resistance, freedom from surface penetration, and good shake-out properties for use in forming an undercut portion of a casting formed from a molten metal mass in a die of a high pressure die casting machine, said core comprising:

(A) a base composed of a sand bound together by a binder;

(B) a first 250 to 5000μ thick coating composed of:

(a) between about 30 and 80% by weight of an inorganic refractory material selected from the group consisting of graphite, mica, fused silica, aluminum oxide, magnesium oxide, carbon black, and zircon flour, and (b) between about 1% and 25% by weight of an inorganic binding agent selected from the group consisting of colloidal silica, clay and amine-treated bentonite; and (C) an additional top and second 100 to 2000μ thick coating comprising:

(a) a refractory material selected from the group consisting of fused silica, zircon flour, and aluminum oxide, (b) a suspending agent selected from the group consisting of colloidal silica, clays and bentonite, and (c) an organic resin binding agent.

2. A sand core according to claim 1 wherein said molten metal mass comprises aluminum.

3. A sand core according to claim 1 wherein said base sand comprises silica sand.

4. A sand core according to claim 1 wherein said base binder comprises an organic resin.

5. A sand core according to claim 4 wherein said organic resin is curable with an acid.

6. A sand core according to claim 4 wherein said organic resin comprises furan.

7. A sand core according to claim 1 wherein said first coating comprises between about 50 and 70% by weight of said inorganic refractory material.

8. A sand core according to claim 1 wherein said first coating refractory material comprises fused silica.

9. A sand core according to claim 1 wherein said first coating binding agent comprises a clay.

10. A sand core according to claim 9 wherein said clay is kaolin clay.

11. A sand core according to claim 1 wherein said first coating binder comprises colloidal silica.

12. A sand core according to claim 1 wherein said top and second coating refractory material comprises zircon flour.

13. A method of coating a bonded sand core having high pressure and temperature resistance, good wash-out resistance, freedom from surface penetration, and good shake-out properties for use in forming an undercut portion of a casting formed from a molten metal mass in a die of a high pressure die casting machine, said sand core comprising sand bound together by a binder, the coating steps comprising:

(A) first coating said cured sand core with 250 to 5000μ thick composition; comprising:

(a) between about 30 and 80% by weight of an inorganic refractory material selected from the group consisting of graphite, mica, fused silica, aluminum oxide, magnesium oxide, carbon black, and zircon flour, (b) between about 1% and 25% by weight of an inorganic binding agent selected from the group consisting of colloidal silica, clay, and amine-treated bentonite, and (c) an aqueous liquid vehicle;

(B) drying said first coating; and (C) coating the dried coating with a 100 to 2000μ thick second and top coating comprising:

(a) a refractory material selected from the group consisting of fused silica, zircon flour, and aluminum oxide, (b) a suspending agent selected from the group consisting of colloidal silicas, clays and bentonite, (c) an organic resin binding agent, and (d) an organic liquid vehicle.

14. A method of coating according to claim 13 wherein said molten metal mass comprises aluminum.

15. A method of coating according to claim 13 wherein said base sand comprises silica sand.

16. A method of coating according to claim 13 wherein said base binder comprises an organic resin.

17. A method of coating according to claim 16 wherein said organic resin is curable with an acid.

18. A method of coating according to claim 16 wherein said organic resin comprises furan.

19. A method of coating according to claim 13 wherein said first coating comprises between about 50 and 70% by weight of said inorganic refractory material.

20. A method of coating according to claim 13 wherein said first coating refractory material comprises fused silica.

21. A method of coating according to claim 13 wherein said first coating suspending agent comprises a clay.

22. A method of coating according to claim 21 wherein said clay is kaolin clay.

23. A method of coating according to claim 13 wherein said first coating binder comprises colloidal silica.

24. A method of coating according to claim 13 wherein said top and second coating refractory material comprises zircon flour.

25. A method of coating according to claim 13 wherein said aqueous liquid vehicle is water.

26. A method of coating according to claim 13 wherein said organic liquid vehicle is isopropyl alcohol.

* * * * *